US006220439B1

(12) United States Patent
Virvo

(10) Patent No.: US 6,220,439 B1
(45) Date of Patent: Apr. 24, 2001

(54) CONTAINER WITH MESSAGE

(76) Inventor: Alexander Virvo, 35 Glen Ter., Stamford, CT (US) 06906

( * ) Notice: Subject to any disclaimer, the term of this patent is extended or adjusted under 35 U.S.C. 154(b) by 0 days.

(21) Appl. No.: 09/411,720

(22) Filed: Oct. 2, 1999

Related U.S. Application Data

(63) Continuation-in-part of application No. 09/387,959, filed on Sep. 1, 1999.

(51) Int. Cl.[7] ..... B65D 85/00

(52) U.S. Cl. ..... 206/459.5; 206/736; 206/778; 40/604

(58) Field of Search ..... 206/232, 459.5, 206/457, 6.1, 736, 778, 767; D11/181, 182; 220/4.21, 4.24, 4.25; 40/603, 604

(56) References Cited

U.S. PATENT DOCUMENTS

| | | | | |
|---|---|---|---|---|
| 2,885,839 | * | 5/1959 | Weiss | 206/459.5 |
| 3,028,070 | * | 4/1962 | Schnur et al. | 206/459.5 |
| 3,918,631 | | 11/1975 | Hackenberg . | |
| 4,171,085 | | 10/1979 | Doty . | |
| 4,304,328 | | 12/1981 | Pilat . | |
| 4,964,513 | | 10/1990 | Ingram et al. . | |
| 4,966,285 | | 10/1990 | Otake et al. . | |
| 5,022,526 | | 6/1991 | Crum . | |
| 5,071,000 | * | 12/1991 | Stewart | 206/459.5 |
| 5,428,913 | * | 7/1995 | Hillstrom | 40/604 |
| 5,893,226 | | 4/1999 | Sophocleous et al. . | |

* cited by examiner

*Primary Examiner*—Paul T. Sewell
*Assistant Examiner*—Shian Luong
(74) *Attorney, Agent, or Firm*—Grimes & Battersby, LLP

(57) ABSTRACT

A container is provided having at least two separate container elements attached by a banner bearing a message, said container elements and banner being formed from a single flexible sheet or paper. Each of the containers has an opening in the top thereof for storage and transportation of a variety of goods. The flexible banner and container elements are formed such that the container elements are adapted to fit adjacent to each other to form a large container. This large container being bordered on all sides by the flexible banner when in the closed position. When the container elements are rotated in opposite directions relative to each other, a message imprinted on the inner surface of the flexible banner is made visible.

10 Claims, 3 Drawing Sheets

CONTAINER WITH MESSAGE

RELATED APPLICATIONS

This is a continuation-in-part of co-pending application Ser. No. 09/387,959 filed on Sep. 1, 1999.

BACKGROUND OF THE INVENTION

1. Field of the Invention

The present invention relates generally to a container, and more particularly, to a container formed from a single flexible sheet or paper having a message imprinted thereon, the flexible sheet being formed so as to create two separate container elements separated by a banner. Each of said container elements has an opening in the top thereof for storage and transportation of a variety of goods, as well as a clear acetate window on an inner surface thereof for displaying such goods.

2. Description of the Prior Art

Containers and other means for storing and transporting goods have been known since ancient times. The use of such containers to display messages has similarly been known for many years. Such messages, however, have typically been limited to messages imprinted on a label or tab that is affixed to the container or storage means.

For example, U.S. Pat. No. 4,304,328 which issued to Pilat on Dec. 8, 1981 for Receptacle Storage Package Having Oblique Surfaces, discloses a receptacle storage package having oblique base surfaces converging so as to tilt the receptacles towards one another. The receptacles would contact each other, in storage, but for the placement of a receptacle restraining piece positioned between the upper surfaces of the receptacles, which restraining pieces bears a message.

Furthermore, the use of packaging having information imprinted thereon is well known. For example, U.S. Pat. No. 3,918,631, which issued to Hackenberg on Nov. 11, 1975 for Decorator Box, discloses a box formed from a single blank having four sides and top and bottom covers. The out wall carries advertising and descriptive material and the inner wall is decorated with a design. Similarly, U.S. Pat. No. 4,964,513 which issued to Ingram, et al. on Oct. 23, 1990 for Package, discloses a cartonless recyclable package for protectively enclosing a product, such as photographic film, comprising a recyclable plastic container and mating cap with recyclably compatible plastic labels thereon bearing product information. An outer sheet can be peeled back to reveal information on the interfacing surfaces of both sheets, and then re-adhered to the inner sheet. A label may be peeled away and re-adhered to some other surface for reference after the product has been removed. A thumb tab on the cap, to facilitate cap removal, is used also to orient the container and cap for appropriate placement of the labels, and to orient the resulting package in a cooperating displaying and dispensing device. In addition, U.S. Pat. No. 5,022,526 which issued to Crum on Jun. 11, 1991 for Label-Containing Package Assembly, discloses a compact piggyback expandable package assembly for dispensing labels for attachment to bottles, containers, and closure caps, as well as to other surfaces. The package assembly is used primarily in the pharmaceutical industry. The package assembly comprises a special foldable package which encloses a set of labels. A resealable tab can be provided to facilitate opening and closing of the package. In the preferred form, the piggyback package assembly has a base or base label which is attached to the package. The underside of the base has adhesive portions so that the package assembly can be mounted upon the top surface of a closure cap of a bottle, a web, or some other surface.

Novelty containers bearing messages are also well known in the industry. For example, U.S. Pat. No. 4,171,085 which issued to Doty on Oct. 16, 1979 for Tear Tab Disposable Cup or Container Structure, discloses a paper or plastic cup or container having a pull-tab extending from the side seam which can be torn off by the consumer to be used as a coupon, proof-of-purchase or to reveal some form of concealed marking which might entitle the consumer to a premium, gift or other consideration. The pull-tab is perforated to maintain the integrity of the container and preventing leakage or spill of the contents.

Message bearing banners may also be used in emergency situations. For example, U.S. Pat. No. 5,893,226 which issued to Sophocleous, et al. on Apr. 13, 1999 for Assistance Summoning Device, discloses a banner-like device made of a light weight, flexible, and foldable sheet of material that is temporarily attachable to vehicles such as cars, trucks, motorcycles, boats, campers, and aircraft. The device includes at least two support rods to maintain the banner in an unfurled position.

In the photographic field, U.S. Pat. No. 4,966,285 which issued to Otake, et al. on Oct. 30, 1990 for Container Having Index Sheet and Recording Medium discloses an index sheet formed of one recording sheet on which are printed a plurality of scenes recorded on an image recording medium such as, for example, a photographic film, a still video floppy, a video cassette, or a video disc. The images are arranged in the same order they were taken, and frame numbers are printed in juxtaposition with the respective positive images. This index sheet can be part of a package comprising a container having a casing formed with at least one recess for the image recording medium and/or printed photographs, and a cover swingably mounted on the casing. A transparent pocket formed on the outer or inner side of the cover contains the index sheet.

However, there are no devices or methods which disclose the use of a single flexible sheet or paper to form two separate container elements attached by a flexible message-bearing banner, which banner retains the containers in the closed position. The prior art containers fail to offer the unique advantages contemplated by the present invention.

SUMMARY OF THE INVENTION

Against the foregoing background, it is a primary object of the present invention to provide a container with banner having at least two separate container elements attached by a banner bearing a message, said container elements and banner being formed from a single flexible sheet or paper.

It is another object of the present invention to provide such a container that is inexpensive to manufacture It is yet object of the present invention to provide such a container that allows for the transportation of at least two separate goods.

It is still another object of the present invention to provide such a container that allows for the storage of at least two goods in two separate and independent chambers.

It is but another object of the present invention to provide such a container that allows for the display of the goods contained therein.

It is another object of the present invention to provide such a container that forms a totally enclosed container in the closed position.

It is still another object of the present invention to provide such a container that reveals a message when the separate container elements are rotated in opposite directions relative to each other.

To the accomplishments of the foregoing objects and advantages, the present invention, in brief summary, comprises a container having at least two separate container elements attached by a banner bearing a message, said container elements and banner being formed from a single flexible sheet or paper. Each of the containers has an opening in the top thereof for storage and transportation of a variety of goods. The flexible banner and container elements are formed such that the container elements are adapted to fit adjacent to each other to form a large container, this large container being bordered on all sides by the flexible banner when in the closed position. When the container elements are rotated in opposite directions relative to each other, a message imprinted on the inner surface of the flexible banner is made visible.

BRIEF DESCRIPTION OF THE DRAWINGS

The foregoing and still other objects and advantages of the present invention will be more apparent from the detailed explanation of the preferred embodiments of the invention in connection with the accompanying drawings, wherein.

BRIEF DESCRIPTION OF THE PREFERRED EMBODIMENTS

Figure 1:
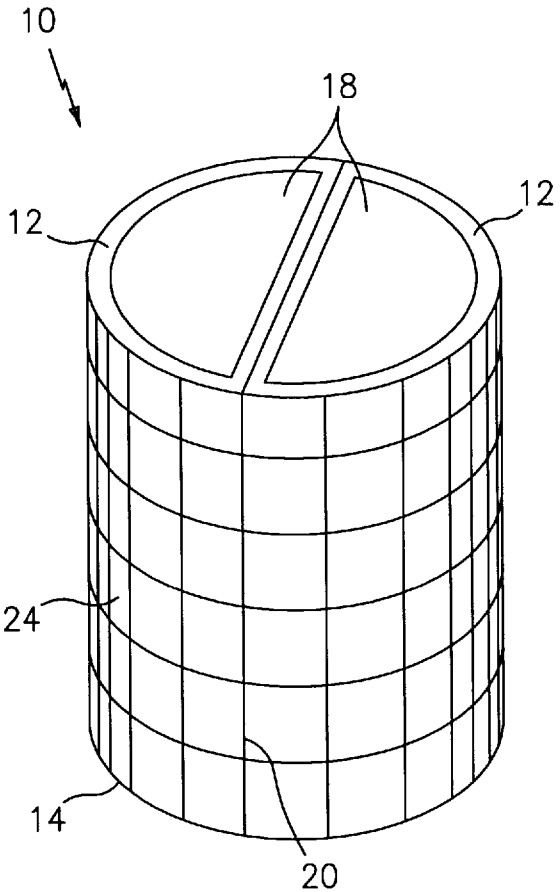
FIG. 1 is a perspective illustration of the container of the present invention in the closed position.

Referring to the drawings and, in particular, to FIG. 1 thereof, the container of the present invention is provided and is referred to generally by reference numeral 10. The container 10 includes at least two separate container elements 12 attached by means of a flexible sheet or paper banner 14, which banner bears a message or graphic image 16. The banner 14 extends around the entire surface of the container 10 in the closed position, which position is illustrated in FIG. 1.

The container elements 12 and banner 14 bearing message 16 are all formed from a single flexible sheet or paper. The use of the single flexible sheet in constructions serves to facilitate the manufacture and construction of the container 10, as well as significantly reduce the costs associated with production.

In the preferred embodiment, each container element 12 is enclosed on the sides and bottom, and has an opening 18 in the top thereof, said opening 18 being adapted to accept a variety of goods such as jelly beans, popcorn, etc. Obviously, the larger the container 10, the larger the goods, such as toys or novelty items, that will fit within each container element 12. Conversely, smaller containers 10 having small container elements 12 may be used for the storage and transportation of such items as beads and the like.

In the preferred embodiment, the shape of the container 10 is rectangular, and each of the container elements 12 is likewise rectangular. Such shape allows for easy construction of the container 10. However, it should be appreciated that the shape of the container elements may also be semi-cylindrical, triangular or otherwise, limited only by the construction constraints of the flexible sheet or paper.

The container elements 12 are adapted to fit adjacent to each other in the closed position to form the larger container 10. In the preferred embodiment, each container element includes a planar surface 22 of substantially the same size and shape, which planar surfaces 22 are adapted to fit adjacent to each other in the closed position. However, it should be appreciated that the surface 22 of the container elements 12 may be of any other configuration, provided that the adjacent surfaces 22 of each container element 12 are complementary to each other.

The banner 14 is attached to the opposite edges 20 of the container elements 12 such that, when the container 10 is in the closed position (reference FIG. 1), the edges 20 are adjacent to each other. When the container 10 is in the closed position, only the outer surface 24 of the banner 14 is visible. The outer surface 24 may contain a design or message appropriate for the goods contained within the container elements 12. For example, if the container 10 is used to convey a birthday wish, the outer surface 24 may contain artwork or a message, while the inner surface 26 may also contain artwork, or a birthday wish or message or even a personalized message. Alternatively, if the container 10 is used to store and transport candy, the outer surface 24 may contain the product name and nutritional information.

Figure 2:
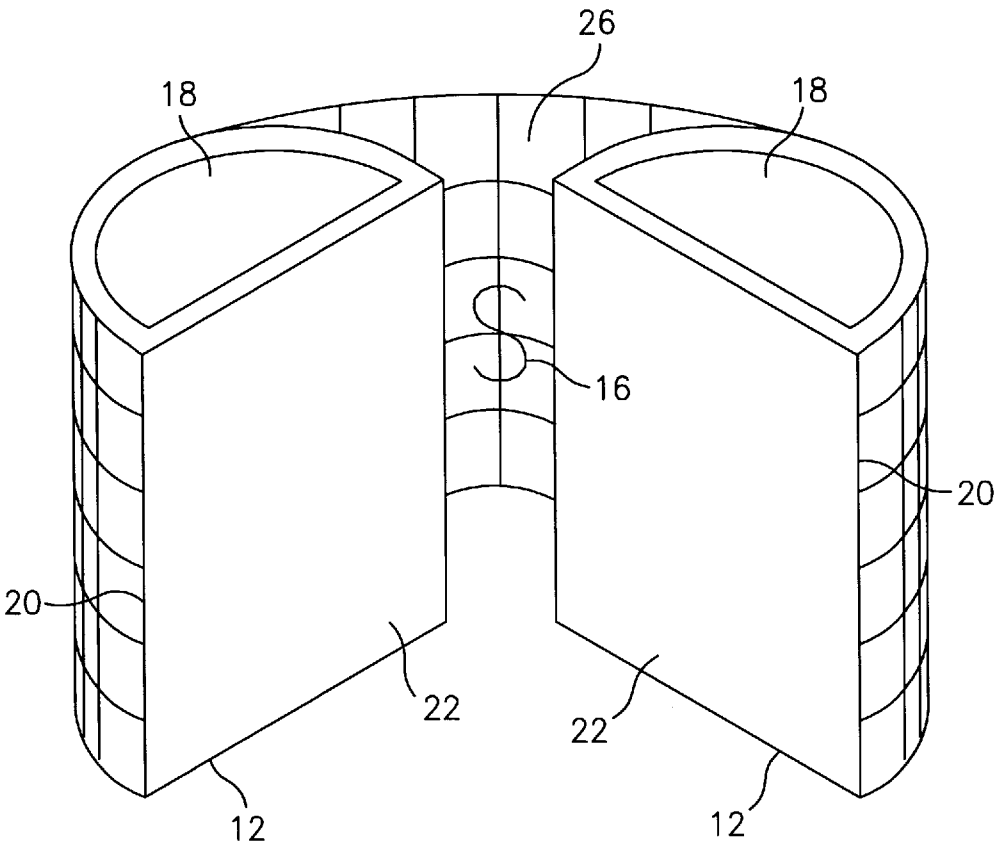
FIG. 2 is a perspective illustration of the container of the present invention in an intermediary state between the closed and open position.
Figure 3:
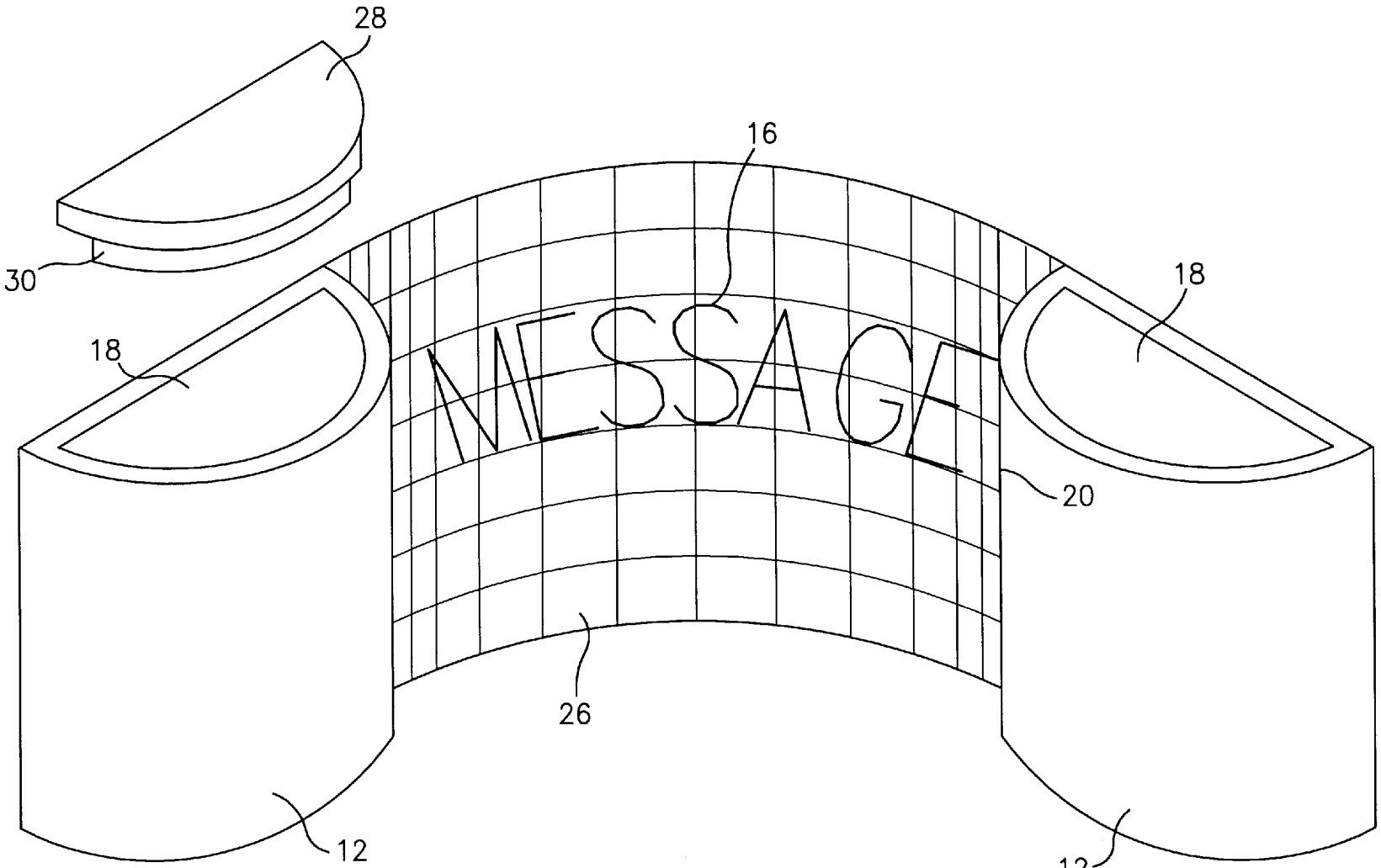
FIG. 3 is a perspective illustration of the container of the present invention in the open position.

In the closed position (reference FIG. 1), the banner 14 serves to retain the separate container elements 12 in such closed position. When container elements 12 are rotated in opposite directions relative to each other, the message 16 imprinted upon the inner surface 26 of the banner is revealed (as shown in FIGS. 2 and 3), which may contain artwork, a message or even a personalized message.

Container tops 28 may also be provided to prevent spillage of the contents of the container elements 12. Container tops 28 may be larger than the opening 18 of the container element 12 so as to allow container tops 28 to sit on the top of container element 12. Container tops 28 include a lip 30 adapted to fit within the opening 18 of container elements 12, said lip 30 being of a size slightly smaller than the opening 18, keeping container top 28 in position by means of a friction fit. It should be appreciated that alternative means for affixing said top 28 to said container element 12 exist, such as hinge means, locks, snaps or straps. However, container tops 28 are not required to retain the integrity of the design.

Figure 4A:
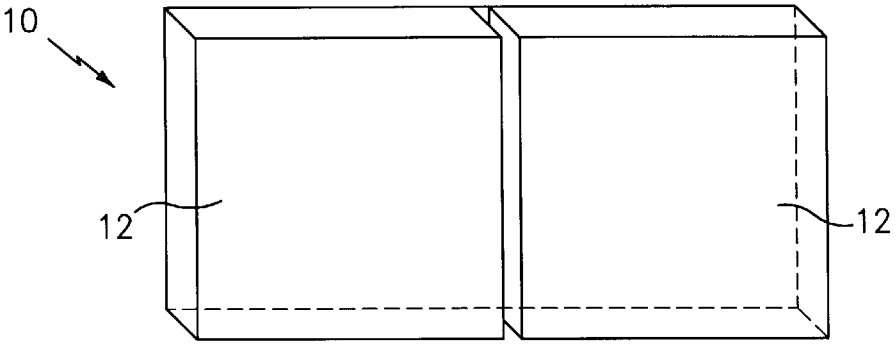
FIG. 4A is a perspective illustration of the container of the present invention in the closed position.
Figure 4B:
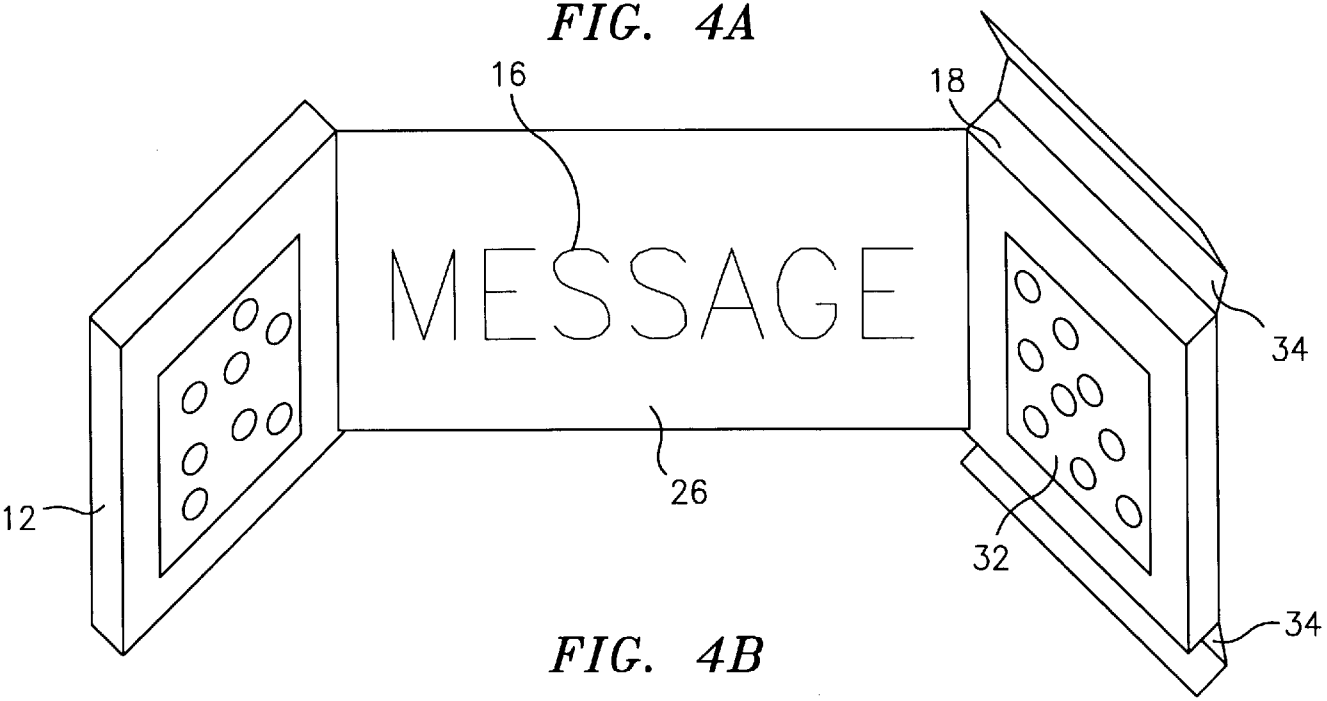
FIG. 4B is a perspective illustration of the container element of the present invention in the opened position.

FIGS. 4A and 4B illustrate the preferred embodiment of the present invention. In FIG. 4A, the container 10 is illustrated in the closed position, with the container elements 12 adjacent to each other and the banner 26 adjacent thereto. As shown in FIGS. 4A and 4B, the banner 26 does not extend around the entire container 10, but merely covers one side of each container element 12. It should be appreciated, however, that the banner 26 may also extend around the entire container 10 so as to cover every external surface thereof FIG. 4B shows the container 10 after the container elements 12 have been rotated relative to each other to display the message 16 imprinted on the banner 26.

Container elements 12 include a window 32 on an inner surface thereof so as to display the contents of the container element 12. In the preferred embodiment, the window 32 is composed of a clear plastic or acetate, although any other transparent medium may be utilized. The window 32 is affixed to the opening in the container element 12 by means of an adhesive or other affixation means such that the window 32 will be stationary during transportation and storage of goods contained within container elements 12.

The openings 18 at the tops and bottoms of the container elements 12 are closed by means of flaps 34 formed from the flexible sheet or paper of the banner 26. Flaps 34 may be opened and closed so as to allow for insertion and removal of objects from the container elements 12. In the preferred embodiment, simple box-top type flaps 34 are used, which flaps 34 serve adequately to retain any items stored in container elements 12. However, other means of securing the openings 18 by means of flaps 34 exist, such as with releasable adhesives, snaps, buttons or hook and loop materials.

For transportation purposes, the separate container elements 12 of container 10 may be secured by means of an adhesive such as tape or a strap (not shown), which adhesive would prevent the container elements 12 from separating during transport. Alternatively, the banner 26 may include an extended flap that can be used to wrap around the entire container 10 when in the closed position. Of course, other means for securing the container 10 during transportation exist, such as a sleeve for inserting the entire container 10, or a separate box.

Having thus described the invention with particular reference to the preferred forms thereof, it will be obvious that various changes and modifications can be made therein without departing from the spirit and scope of the present invention as defined by the appended claims.

Wherefore, I claim:

1. A container for the distribution and display of promotional and novelty items, said container having an open and closed position and comprising:

at least two separate container elements adapted to receive and store said promotional and novelty items, said elements comprising:

a front panel and back panel of identical dimensions;

complementary planar side surfaces, such that said container elements are adapted to fit adjacent to each other at said complementary surfaces when said container is in said closed position; and top and bottom openings, said openings including flap closure means;

a flexible banner having interior and exterior surfaces affixed to said container elements by means of a flexible joint, wherein the length of said banner is at least as long as the combined width of said elements;

wherein said elements cover said interior surface when said container is in said closed position, and wherein said elements reveal said interior surface when said container is in said open position.

2. The container of claim 1, said container elements and said flexible banner being composed of a single sheet of flexible material.

3. The container of claim 2, wherein said flexible material is paper.

4. The container of claim 1, said container elements including a clear window for displaying said food and candy and novelty items.

5. The container of claim 1, having exactly two container elements being equal in size and shape.

6. The container of claim 5, wherein said container elements are rectangular in shape.

7. The container of claim 1, wherein a graphic image is affixed to the interior surface of said banner such that said graphic image is only visible when said container is in said open position.

8. The container of claim 1, wherein a graphic image is displayed upon the inner surface of said banner.

9. A container for the distribution and display of promotional and novelty items, said container having an open and closed position and comprising:

two separate rectangular container elements adapted to receive and store said promotional and novelty items, said container elements comprising:

a front panel and back panel of identical dimensions;

complementary planar, equal-sized side surfaces adapted to fit adjacent to each other at said complementary planar surfaces when said container is in said closed position;

top and bottom openings, said openings including flap closure means; and at least one clear window disposed on at least one of said elements for displaying said food and candy and novelty items; and a flexible banner having interior and exterior surfaces affixed to said container elements by means of a flexible joint, wherein the length of said banner is at least as long as the combined width of said elements, and further wherein a message or graphic image is displayed upon said interior surface thereof, said container elements and said banner being composed of a single sheet of flexible material, wherein said flexible material is paper;

wherein said elements cover said interior surface when said container is in said closed position, and wherein said elements reveal said interior surface when said container is in said open position.

10. A method for distributing and displaying promotional and novelty items and delivering a message, said method comprising the steps of:

providing a container comprising:

at least two separate container elements adapted to receive and store said promotional and novelty items, said elements comprising:

a front panel and back panel of identical dimensions;

complementary planar side surfaces, such that said container elements are adapted to fit adjacent to each other at said complementary surfaces when said container is in said closed position;

top and bottom openings, said openings including flap closure means; and a clear window for displaying said promotional and novelty items;

a flexible banner having interior and exterior surfaces affixed to said container elements by means of a flexible joint, wherein the length of said banner is at least as long as the combined width of said elements, said container elements and said banner being composed of a single sheet of flexible material, wherein said material is paper; and wherein said elements cover said interior surface when said container is in said closed position, and wherein said elements reveal said interior surface when said container is in said open position;

imprinting a graphic image on said interior surface of said banner;

inserting said promotional and novelty items into said container elements;

rotating said container elements relative to each other during transportation and storage such that said complementary surfaces are adjacent to each other and cover said interior surface.

* * * * *